US008186396B2

(12) United States Patent
Piland

(10) Patent No.: US 8,186,396 B2
(45) Date of Patent: May 29, 2012

(54) AVIATION REFUELING FILTER INSPECTION APPARATUS

(75) Inventor: Robert Bruce Piland, Tulsa, OK (US)

(73) Assignee: Robert B. Piland, Tulsa, OK (US)

( * ) Notice: Subject to any disclaimer, the term of this patent is extended or adjusted under 35 U.S.C. 154(b) by 1099 days.

(21) Appl. No.: 12/010,003

(22) Filed: Jan. 18, 2008

(65) Prior Publication Data

US 2008/0173361 A1 Jul. 24, 2008

Related U.S. Application Data

(60) Provisional application No. 60/881,176, filed on Jan. 19, 2007.

(51) Int. Cl.
*F02M 37/22* (2006.01)

(52) U.S. Cl. ..... 141/384; 210/85; 210/234; 210/248; 210/460; 141/86; 141/88; 137/312; 137/313; 184/1.5

(58) Field of Classification Search ..... 210/234, 210/460, 248; 137/313, 549, 312; 141/86, 141/87, 88, 384; 73/802; 285/13
See application file for complete search history.

(56) References Cited

U.S. PATENT DOCUMENTS 5,313,991 A * 5/1994 Murray et al. ..... 141/86
5,647,412 A * 7/1997 Brewer ..... 141/86
6,769,309 B1 * 8/2004 Gammon ..... 73/802

* cited by examiner

*Primary Examiner* — Nam Nguyen
*Assistant Examiner* — Paul J Durand

(57) ABSTRACT

A time and labor saving device used in the aviation refueling process for holding an aviation style fuel nozzle in place over a open vessel with a support base so that the filter screen may be easily inspected while additionally providing for the collection and recycling of fuel that is lost while inspection is made.

14 Claims, 2 Drawing Sheets

AVIATION REFUELING FILTER INSPECTION APPARATUS

This application claims benefit of provisional application No. 60/881,176 filed on Jan. 19, 2007

FIELD OF THE INVENTION

The present invention relates to improvements in the process and procedures for the inspection and replacement of fuel filters and/or filter screen specifically used in aircraft refueling operations at airport ground fueling stations as specifically set forth by the Air Transport Association otherwise known as ATA. The ATA specifications are the results of 12 international industry associations who represent airlines, manufacturers, suppliers and repair agencies associated with the airline industry.

An additional feature of the invention is in the reclaiming and reuse of aviation fuel within the considerable length of hose that extends from the fueling truck to the aircraft when said hose must be removed for inspection and or replacement. There can be large amounts of aviation fuel remaining in the fuel line that can be potentially lost during the required hose replacement process. This invention allows for this fuel to be reclaimed in a novel and efficient manner wherein the hose is attached via the Underwing Nozzle to the invention to allow venting during this process.

BACKGROUND OF THE INVENTION

ATA Specification 103 identifies certain quality inspection procedures and safety tests commonly used at storage and transportation facilities that handle jet fuel. It also includes certain forms designed to record performance of the appropriate tests and inspections. All aviation refueling operations must comply with these procedures.

ATA Specifications are created by the airline industry to revolutionize the multi-billion dollar aviation parts business; ATA specifications are a comprehensive set of specifications, products and services that are designed to overcome challenges that have plagued the industry for decades.

Widely used by the world's airlines and suppliers, the system has served the industry for more than 40 years and has evolved to embrace the latest technological advances in information exchange, by streamlining business and operational processes and reducing administrative costs.

ATA specifications have grown to become the backbone of the aviation industries current process and quality controls. As a result, the industry has attributed significant operational efficiencies and cost savings to ATA specifications.

Among one of these very important procedures that must be carried out on a routine basis is the inspection and replacement of a fuel filter screen assembly that resides in the Underwing Nozzle. The filter screen acts as the final fuel filtering component before aviation fuel enters the aircraft. The fuel screen comprises of an non-bypassable 100 mesh nozzle/connector screen formed in a cone and affixed to a ring with a snap and or removal apparatus. The invention allows for this very important component to be inspected in an improved fashion.

Specifically, Specification 103 states that each Underwing Nozzle fuel screen be examined for particles or other solid contaminants and furthermore states that if particles are found that the operator is to investigate possible sources of contamination. Specification 103 additionally requires a form to be filled out to document the inspection and that the form is retained for 12 months. There are several manufacturers of the Underwing Nozzle and this predominate nozzle is utilized worldwide by more companies and at more airports than any other nozzle. Tens of thousands of these nozzles are used on a daily basis for commercial aviation refueling, military operations and private jet refueling.

Current operations for inspection and changing this fuel screen assembly include one person holding the Underwing Nozzle while another person facilities the operation of disconnecting the hose from the Underwing Refueling Nozzle to inspect the filter screen assembly. The present invention allows for a two man operation to become a one man operation.

During this operation the aviation fuel within the hose and nozzle are lost or otherwise spilt upon the ground. Some airport refueling operators will perform this operation over a bucket in the attempt to catch some of the fuel.

While lost fuel is expected in current inspection operations there is the danger that particles and/or other contamination that could be from inner hose lining, pipe rust, sand, low point sediment, equipment failure, seals, gasket, etc. will be flushed out with the loss of fuel and that early detection of contamination indicators will not be apparent, as they are lost with the spilt fuel.

In most cases the fuel is lost and spilt on the ground causing both environmental and fire hazard concerns for airport operators. Said fuel can also be splashed or otherwise spilled on the operators during this inspection procedure.

Even the manufacturer of the Underwing Nozzle acknowledges this problem and states in their catalogs that with a standard nozzle/hose system, the hose must be drained to accomplish checking the filter.

Even if additional steps are utilized to prevent this problem such as using a commercially available Dry Break apparatus instead of the standard quick disconnect, the fuel in the nozzle still needs to be caught during the inspection of the filter screen and the fuel is typically spilt upon the ground.

An additional important feature of the invention is in the hose replacement process of the fueling truck wherein the pumping action of the fuel truck is reversed to become a vacuum or suction action to drain the fuel hose contents back into the fuel truck tank.

While the Underwing Nozzle is attached to the invention the nozzle poppet valve remains open while the hose is redirected to the suction side of the truck pump from the pumping or discharge side for the purpose of draining the fuel hose.

The present operation procedure includes operators manually opening a poppet valve on the Underwing Nozzle so that fuel can be removed from up to fifty feet of hose. This operation can typically require more than one operator to perform.

A poppet valve on a Underwing Nozzle will consist of a hole, usually round or oval, and a tapered plug, usually a disk shape on the end of a shaft, sometimes called a valve stem. This valve must be opened to allow suction from the Underwing Nozzle for reclaiming the fuel contents from the volume of the hose to the fuel truck tank.

The invention as described herein allows for one person to perform this operation thus saving additional man hours while also creating a more efficient operational procedure.

SUMMARY OF THE INVENTION

An object of the present invention is to remedy this problem of spilt fuel and to further more improve the quality control process by allowing for one individual to perform this operation instead of the present practice of utilizing two people, thus saving man hours and resources.

The improved process allows for quicker and more efficient operation while saving the fuel for further inspection and proper disposal. This procedure will also eliminate the unnecessary spillage of aviation fuel on the ground where it can seep into the groundwater causing environmental and safety concerns.

In accordance with the present invention an improved and novel means of checking the aviation refueling nozzle fuel screen is performed by providing a container or fuel receptacle for the purpose of receiving fuel lost during the inspection procedure.

Said container having a central opening and an annular bayonet connector mounted at an angle provides a complementary configuration to receive and engage an underwing nozzle wherein said nozzle may be connected and held in place so that a single operator can break apart the filter screen connection and make required inspections and replacement.

The invention as described, allows for the procedure to be reduced from a two man operation to a one-man operation while also collecting the spilt fuel for recycling and safe removal.

Once the Underwing Nozzle is serviced, the nozzle is quickly reconnected and put back into service and the container can be easily removed and drained of contaminates and fuel.

Additionally, during the fuel hose replacement process one operator can now connect the Underwing Nozzle to the invention thereby mechanically opening he poppet valve so that the same operator can then also operate the suction controls for removing the fuel from the hose length.

Said invention taking the place of a second operator that would normally have to physically open the poppet valve or otherwise disconnect the dry break to allow for air to be vented or otherwise sucked into the hose for the operation to be completed. The invention additionally collects the fuel that is lost during the operation of removing the Underwing Nozzle from the fuel hose.

Said invention may incorporate many different embodiments that will better customize it use to a particular operational use. Said customization may include adding a splashguard to protect user from fuel exposure or the ability to adjust the direction of the bayonet adaptor.

Additional customization may include the use of a means to utilize interchange bayonet adapters of different sizes and styles or adding extended footing support by means of extended feet with studs or cleats to better hold the invention in place.

Other options may also include adding a drain, adding handles for ease of movement, or adding cut outs or opening in the footing to reduce weight.

From the foregoing, it will be apparent that the present invention provides for a novel and improved means for filter inspection and whereas the present invention has been described in a particular fashion, it should be understood that other and further modifications apart from those shown or suggested herein may be made within the scope of the invention.

The foregoing and other objectives, features, and advantages of the invention will be more readily understood upon the consideration of the following detailed description of the invention.

BRIEF DESCRIPTION OF THE DRAWINGS

The figures of the appended drawing will illustrate the manner in which the invention may be embodied. In these figures, identical references designate similar elements.

DESCRIPTION OF THE PREFERRED EMBODIMENT

Figures 1, 2, 3, 4, 5:
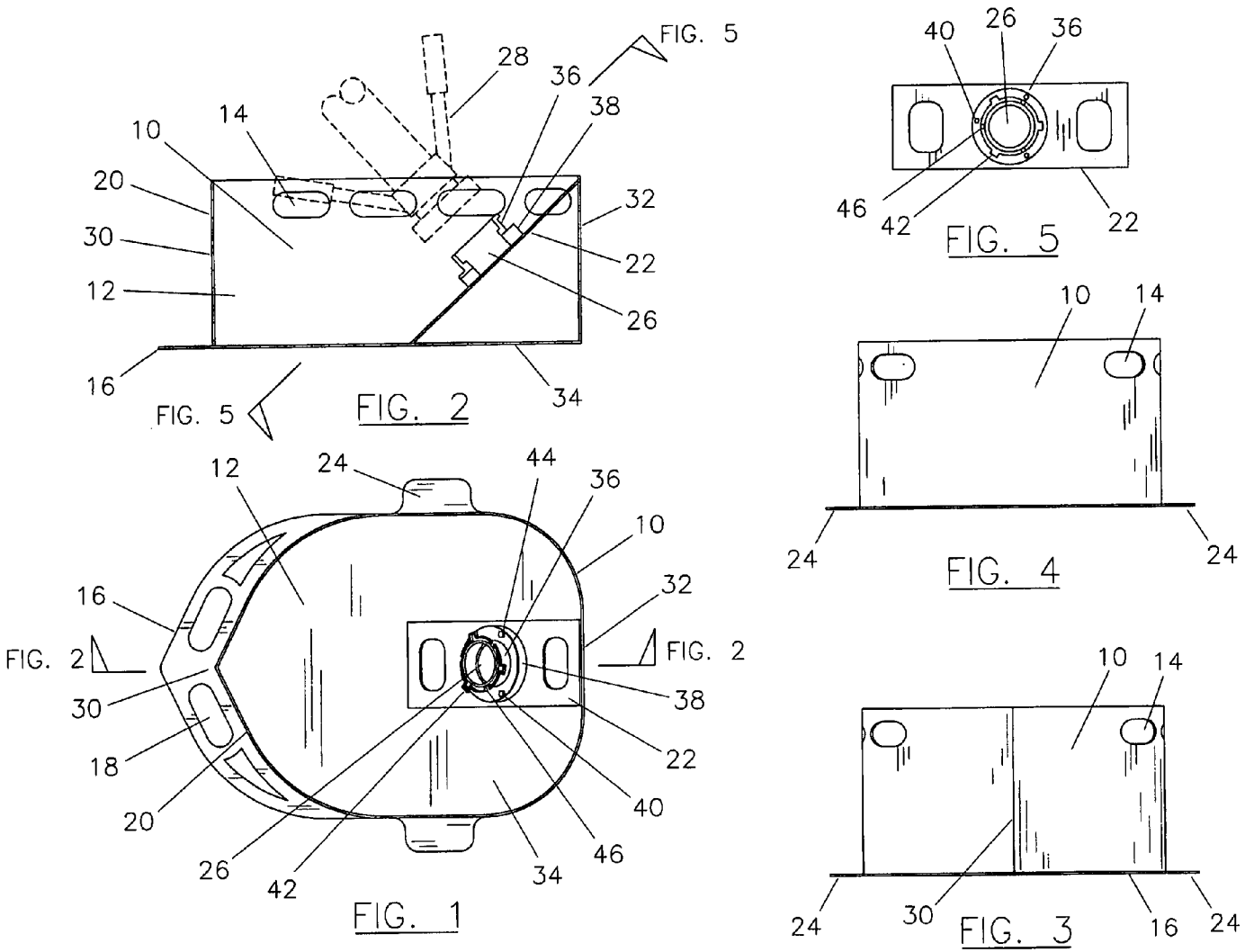
FIG. 1 is a top plan view of the invention
FIG. 2 is a sectional view taken from FIG. 1 as shown
FIG. 3 is a front elevational view
FIG. 4 is a rear elevational view
FIG. 5 is an enlarged plan view of the bayonet connector
Figure 7:
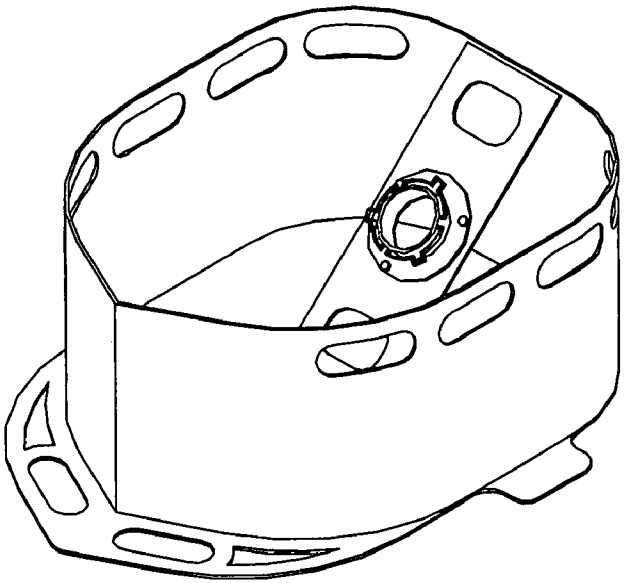
FIG. 7 is a perspective view
Figure 6:
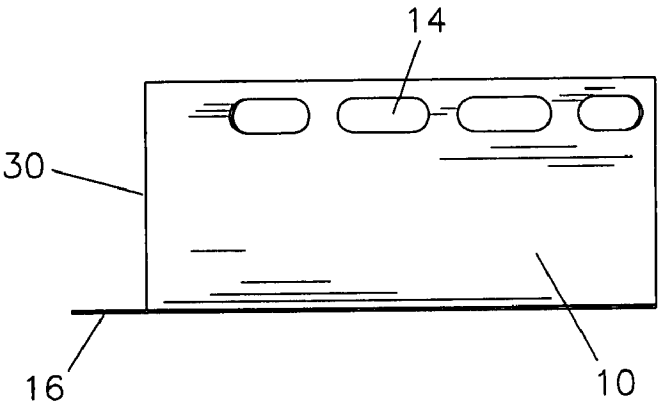
FIG. 6 is a side elevational view, wherein each side is identical

FIG. 1 shows a plan view of the Aviation Refueling Filter Inspection Apparatus 10 comprising a canister, bucket, or container 12 having a plurality of openings 14 near the upper most part of the container near the proximity of the top rim.

Said openings 14 for the purpose of and designed to facilitate the ease of transport and to make it easy to carry the invention 10 to desired locations. Ease of transport is important, as filter screen inspection is typically preformed on the airport tarmac or at other fueling locations requiring that the invention be portable.

Openings 14 additionally providing a lighter weight unit and additionally providing for attachments and or hooking means for attaching invention 10 on a refueling truck or like transport vehicle.

Container 12 shall be constructed of a rigid material suitable for the retaining of aviation fuel or like liquids and may be constructed of aluminum, steel, plastic, or other suitable material so the invention 10 can be lightweight and rugged in construction. The invention 10 shall have a general rectangular form or like shape.

The front portion 20 of container 12 shall have a configuration similar to that of a bow or a front section of a boat or ship and shall come to a point 30 so that fuel shall be easily directed when it is poured from the container 12 to other receptacles (Not Shown). The front portion 20 of the container 12 thus creates a configuration that may be more easily identified for quick alignment of the Underwing Nozzle 28 shown in FIG. 2 utilized in refueling aircraft.

Container 12 shall be affixed or otherwise mounted to a rigid base support 16 with said base 16 extending beyond the front of the container 12 a number of inches so that an operator may apply their feet to the base support 16 for supporting and to steady the invention 10 during operations as may be required.

Container 12 shall also have an extension of the base 16 on each side of the container 12 as required comprising a set of tabs 24 wherein tabs 24 are centrally located for applying additional footing base support as may be required.

Footing base support 24 extends beyond the edge of said open vessel and may also completely go around said open vessel, providing a footing upon which to stand, wherein said footing may either be solid or have openings or cutouts to reduce weight.

Footing base support 24 may have cleats or studs for better contact with asphalt.

Additionally, base support 16 shall have a plurality of openings 18 for the purpose of removing weight from the invention 10 and to further facilitate a fastening or mounting means for ease of transport.

Container 12 shall also have centrally affixed within the void or open chamber of the container 12 an adapter plate 22 affixed or otherwise connected to the rear portion or rear wall 32 and shall furthermore be connected to the bottom of container floor 34 of the container 12 so as to form angled alignment shown more clearly in FIG. 2.

Adapter plate 22 shall have a centered or otherwise centrally disposed bayonet type engagement connection 36 for securing the complementary and mating connection to an underwing nozzle 28 Shown in FIG. 2. Bayonet type engagement connection 36 comprising of a hollow extension tube 38 with a wall thickness suitable for drilling mounting holes 40.

Said bayonet connector 36 mounted directly over adapter opening 26 allowing for fuel to flow into container 12.

Said centrally placed bayonet adapter connector may in one embodiment have a means to adjust the position of the bayonet for ease of use. A bayonet bracket may additionally be provided for interchanging different bayonet sizes and brackets. (Not Shown)

Hollow extension tube 38 shall be welded or otherwise affixed to the adapter plate 22 in any suitable manner so that it will remain rigid. Extension tube 38 shall have on the top circumference a plurality of tapped holes 40 for attachment of a bayonet connector 36 designed to match a 3-lug international standard aircraft adapter that is utilized on aircraft fueling applications.

Bayonet connector 36 shall be mounted to extension tube 38 with a plurality of commercially available bolts 44 as required. Bayonet connector 36 providing for a quick connect and disconnect with an Underwing Nozzle 28. Bayonet connector shall be of a complementary design to mimic or reproduce the International Standard Aircraft Bayonet Type Coupler connection.

Bayonet connector 36 furthermore having a plurality of mating lugs or prongs 42 extending radially outward from its circumference and a plurality of indexing slots 46 therein configured and dimensioned for complementary mating insertion into the Underwing Nozzle 28 wherein said mating lugs are slidably inserted and engagable by turning the Underwing Nozzle 28 a predetermined degree to form a locking connection between the bayonet connector 36 and the Underwing Nozzle 28.

Said connection facilitates the positioning of the Underwing Nozzle 28 so that it is now positioned and ready for a quick disconnect of the hose or dry break for inspection of the filter screen providing for a new and improved method of inspection utilizing only one person. Fuel that is lost in the inspection falls into the container 12 for easy removal and inspection for contamination. Other embodiments may include a drain, additional handles, or splashguards.

It maybe thus seen that the objects of the present invention set forth, as well as those made apparent from the forgoing description are efficiently attained. While preferred embodiments of the invention have been set forth for purposes of disclosure, modifications of the disclosure embodiments of the invention as well as other embodiments thereof may occur to those skilled in the art accordingly. The appended claims are intended to cover all embodiments that do not depart from the spirit and scope of the invention.

What is claimed is:

1. An underwing fueling nozzle filter screen inspection apparatus, primarily used in the aviation re-fueling industry for receiving spilled fuel, comprising:

(a) an underwing fueling nozzle attached to a re-fueling hose, said underwing fueling nozzle comprising a filter screen;

(b) a vessel comprising: a bottom, an open top, upstanding side and rear walls and a bow-shaped front;

(c) a rigid base support upon which said vessel is mounted, said rigid base support extending beyond the edge of said vessel, completely or partially surrounding said vessel, providing a footing upon which to stand, wherein said footing may either be solid or have openings or cutouts to reduce weight, and (d) a bayonet adaptor connector centrally mounted within said vessel configured to receive and hold in place said underwing fueling nozzle, allowing the underwing fueling nozzle filter screen to be inspected and replaced if needed, while spilled fuel is collected in said vessel.

2. An underwing fueling nozzle filter screen inspection apparatus as in claim 1 wherein said vessel has a closable lid.

3. An underwing fueling nozzle filter screen inspection apparatus as in claim 1 wherein said vessel has a splashguard.

4. An underwing fueling nozzle filter screen inspection apparatus as in claim 1 wherein the bayonet adaptor connector is configured to rotate when receiving said underwing fueling nozzle.

5. An underwing fueling nozzle filter screen inspection apparatus as in claim 1 wherein the underwing fueling nozzle is configured to rotate when being received by said the bayonet adaptor connector.

6. An underwing fueling nozzle filter screen inspection apparatus as in claim 1 wherein the bayonet adapter connector is removably mounted in said vessel so it may be interchanged with a bayonet adaptor configured to receive a different size or style of underwing fueling nozzle.

7. An underwing fueling nozzle filter screen inspection apparatus as in claim 1 wherein said rigid base support extends beyond the edge of said vessel, completely surrounding said vessel.

8. An underwing fueling nozzle filter screen inspection apparatus as in claim 1 wherein said rigid base support extends beyond the edge of said vessel on both sides of the vessel.

9. An underwing fueling nozzle filter screen inspection apparatus as in claim 1 wherein said rigid base support extends beyond the edge of said vessel at the front and the rear the vessel.

10. An underwing fueling nozzle filter screen inspection apparatus as in claim 1 wherein said rigid base support has cleats or studs for securing said rigid base support into asphalt.

11. An underwing fueling nozzle filter screen inspection apparatus as in claim 1 wherein said vessel has a drain on the bottom.

12. An underwing fueling nozzle filter screen inspection apparatus as in claim 1 wherein handles are attached to said apparatus.

13. An underwing fueling nozzle filter screen inspection apparatus as in claim 1 wherein said vessel has openings or cutouts to reduce weight.

14. An underwing fueling nozzle filter screen inspection apparatus, primarily used in the aviation re-fueling industry for receiving spilled fuel, comprising:

(a) an underwing fueling nozzle attached to a re-fueling hose which is in fluid communication with a fuel truck via a reversible pump, said underwing fueling nozzle comprising a filter screen;

(b) a vessel comprising: a bottom, an open top, upstanding side and rear walls and a bow-shaped front;

(c) a rigid base support upon which said vessel is mounted, said rigid base support extending beyond the edge of said vessel, completely or partially surrounding said vessel, providing a footing upon which to stand, wherein said footing may either be solid or have openings or cutouts to reduce weight, and (d) a bayonet adaptor connector centrally mounted within said vessel configured to receive and hold in place said underwing fueling nozzle in an open position, allowing for the venting of air, so that said fuel truck can remove residual fuel from said re-fueling hose if it needs to be replaced.

* * * * *